United States Patent [19]

Gelhard

[11] Patent Number: 4,663,952

[45] Date of Patent: May 12, 1987

[54] DEVICE FOR THE CONTACTLESS COUPLING OF THE CONTROL AND OUTPUT CURRENTS BETWEEN THE ELECTRONIC ELEMENTS ON THE LOCKING CYLINDER AND THE ELECTRONIC ELEMENTS IN THE KEY OF AN ELECTRO/MECHANICAL LOCKING DEVICE

[76] Inventor: Egon Gelhard, Zum Kelderberg 5, D-5352 Zulpich-Durscheven, Fed. Rep. of Germany

[21] Appl. No.: 819,156

[22] Filed: Jan. 14, 1986

[30] Foreign Application Priority Data

Jan. 18, 1985 [DE] Fed. Rep. of Germany ..... 3501482

[51] Int. Cl.[4] ..... E05B 47/00

[52] U.S. Cl. ..... 70/278; 70/408

[58] Field of Search ..... 70/276, 277, 278, 408; 361/171, 172; 340/542, 825.3, 825.31, 825.32, 825.34

[56] References Cited

U.S. PATENT DOCUMENTS

| | | | |
|---|---|---|---|
| 3,733,862 | 5/1973 | Killmeyer | 70/277 |
| 3,848,229 | 11/1974 | Perron et al. | 235/382 |
| 3,872,435 | 3/1975 | Cestaro | 340/825.32 |
| 3,979,647 | 9/1976 | Perron et al. | 70/277 X |
| 4,196,347 | 4/1980 | Hadley | 340/825.31 X |
| 4,250,533 | 2/1981 | Nelson | 70/278 X |
| 4,286,305 | 8/1981 | Pilat et al. | 361/172 |
| 4,509,093 | 4/1985 | Stellberger | 340/825.31 X |

FOREIGN PATENT DOCUMENTS

| | | | |
|---|---|---|---|
| 105139 | 4/1984 | European Pat. Off. | 70/276 |
| 115747 | 8/1984 | European Pat. Off. | 70/277 |
| 3244566 | 6/1984 | Fed. Rep. of Germany | 70/277 |
| 2079842 | 1/1982 | United Kingdom | 70/277 |
| 2158870 | 11/1985 | United Kingdom | 70/278 |

*Primary Examiner*—Robert L. Wolfe

*Attorney, Agent, or Firm*—Collard, Roe & Galgano

[57] ABSTRACT

There is provided a device for the contactless coupling of control and output currents between the electronic elements on a locking cylinder and the electronic elements in the key of an electro/mechanical locking system. The device is characterized by a multiple coupler consisting of a part integrated in the key, preferably in the handle of said key, and a part disposed on the periphery of the locking cylinder, so that when the key is inserted in the locking cylinder, the two parts oppose each other at least at one point in such a way that contactless electrical coupling of the control and output currents is possible between the electronic elements on the locking cylinder and the electronic elements in the key.

6 Claims, 4 Drawing Figures

DEVICE FOR THE CONTACTLESS COUPLING OF THE CONTROL AND OUTPUT CURRENTS BETWEEN THE ELECTRONIC ELEMENTS ON THE LOCKING CYLINDER AND THE ELECTRONIC ELEMENTS IN THE KEY OF AN ELECTRO/MECHANICAL LOCKING DEVICE

The present invention relates to a device for the contactless coupling of the control and output currents between the electronic elements on the locking cylinder and the electronic elements in the key of an electro/mechanical locking device.

Electro/mechanically operated locking devices are well known. In such known devices, electronic elements are arranged in the key which cooperate with communicating electronic elements provided in or on the locking cylinder. The function of the electronics of such devices is to make the lock safe with the help of a defined electronic code system with respect to the locking and unlocking of the lock as well as with respect to signalling sabotage.

However, known locking systems of the above described type have significant drawbacks because the mechanical system requires extensive manipulation. Furthermore, no contactless current supply or feed and/or signal transmission is possible between the electronic elements in the key and on or in the locking cylinder.

It is, therefore, the object of the present invention to provide a contactless coupling or communication between the electronic elements on the locking cylinder and in the key without requiring any manipulation of the locking cylinder and with a contactless transmission of the control and output currents for the electronics in the key. Furthermore, the total electronic security and monitoring system is designed in such a way that it may be installed in existing, i.e. installed central locking systems, whose removal and replacement by new locking systems would be costly, for example in connection with large facilities such as public or government and industrial buildings and hospitals, which frequently have locking systems comprising a thousand and more locking cylinders.

This object is accomplished in accordance with the present invention by a device of the type described above having a multiple coupler consisting of a part which is integrated in the key, preferably in the key handle, and a part disposed on the periphery of the locking cylinder, in a way such that when the key is inserted in the locking cylinder, the two parts are disposed opposite each other at least at one point in such a way that a contactless electrical coupling of the control and output currents is possible between the electronic elements on the locking cylinder and the electronic elements in the key.

According to a preferred embodiment of the device of the present invention, the part of the multiple coupler which is integrated in the key consists of one half of a miniature shell core provided with a coil and having a passive or active opto-electronic element arranged in its center bore. The part of the multiple coupler disposed on the side of the locking cylinder consists of the other half of the miniature shell core provided with a coil and having an active or passive opto-electronic element inserted in its center bore, so that when the key is inserted, only a narrow air gap is formed between these shell core halves at least at one point.

With the device according to the present invention, the basic object is achieved owing to the fact that the locking cylinder of an existing locking system remains completely untouched and no manipulation of or interference with the locking cylinder is required. Only the part on the key must be integrated in the key, while the part on the cylinder may be arranged on the periphery of the locking cylinder in the shield of the lock or in the door depending on design, i.e., depending on whether or not the door is fitted with a shield or plate for the lock.

It has been found particularly preferable and favorable in terms of cost if the multiple coupler is provided in the form of a miniature shell core, one half of which is integrated in the key and the other half of which is mounted in a suitable place on the periphery of the locking cylinder, with provision made for axial adjustability in order to permit an optimally narrow adjustment of the air gap. The coupler is designed in such a way that an active or passive opto-electronic element is arranged in the center bore of each half of the shell core. The opto-electronic element may be either an opto-diode or an opto-transistor. Such a design significantly increases the safety and possibility of signal transmission.

The safety and possibility of signal transmission may be enhanced further by integrating in the key a U-shaped ferrite rod instead of the shell core. In this way, a significantly larger winding and thus higher induction may be produced, which increases the transmission of current feed output.

In a particular embodiment of the invention, the coil and the photo-electronic element in the key are connected to a microcomputer or microcontroller preferably accommodated in the handle of the key, and the coil and the photo-electronic element on the periphery of the locking cylinder are connected to the communicating electronics of the locking cylinder so as to permit a bidirectional contact between the microcomputer and the communicating electronics and to transmit the output for the microcomputer in the key.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views.

Figure 1:
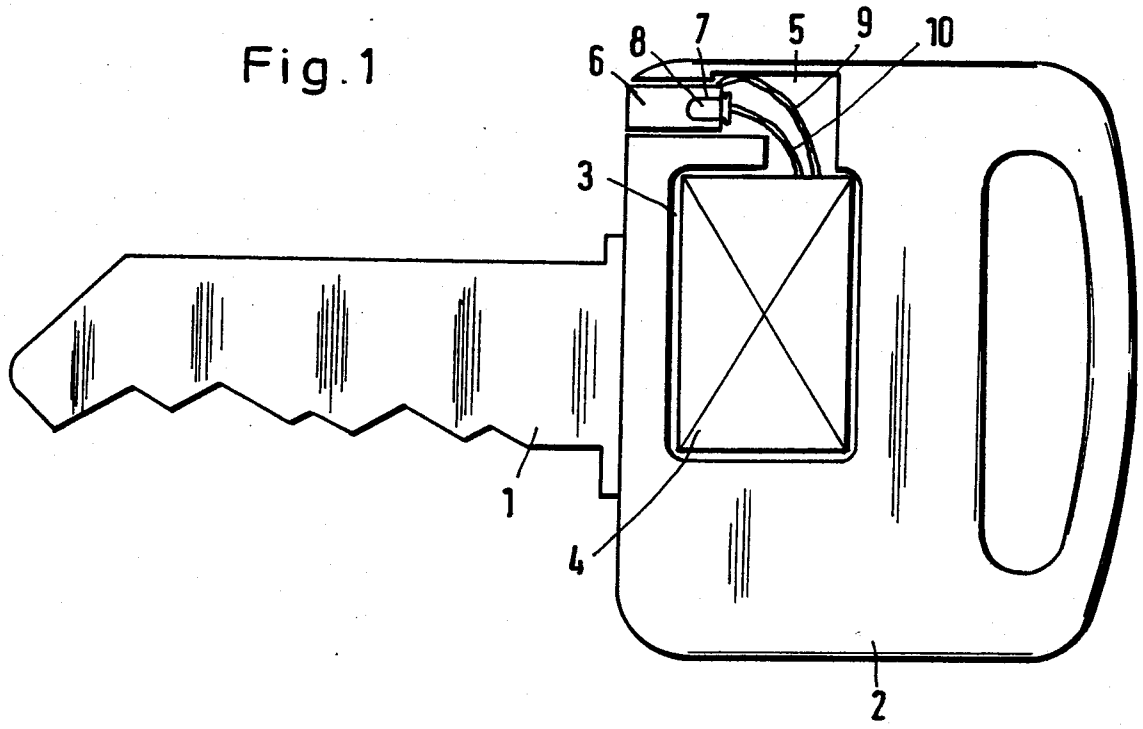
FIG. 1 is a diagrammatic lateral view of a key with a part thereof broken away showing the device according to the present invention.

Now turning to the drawings, there is shown in FIG. 1 a key consisting of a key bit 1 and a handle 2 having a recess 3 accommodating therein a microcomputer or microcontroller 4. The part of a multiple coupler which is integrated in said key is arranged on the top side in a recess 5. This part of the multiple coupler consists of a miniature shell core half, designated 6, which is provided with a coil having a passive or active opto-electronic element 8 arranged in its center bore 7. By way of example, this opto-electronic part may consist of an opto-diode or an opto-transistor. The coil of shell core half 6 is connected to computer 4 by means of leads 9. The opto-electronic element 8 is connected to computer 4 by means of leads 10.

Figure 2:
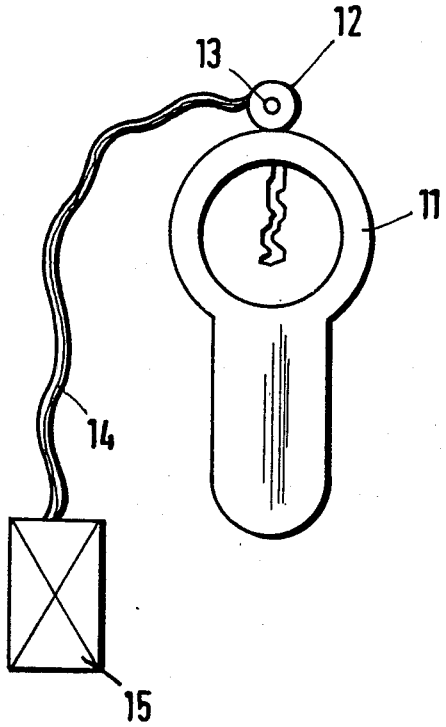
FIG. 2 is a diagrammatic front elevational view of a locking cylinder with the device of the present invention arranged on the periphery thereof.

In FIG. 2 there is shown a locking cylinder 11 arranged in the door (not shown) or in any wall. The other half of the miniature shell core, designated 12, is disposed within the zone of the periphery of locking cylinder 11 and is provided with a coil having an active or passive opto-electronic element 13 inserted in its center bore. The coil of shell core half 12 and opto-electronic element 13 are connected to the communicating electronics 15 on locking cylinder 11 by means of leads 14.

Shell core halves 6 and 12 may each be made adjustable axially by means of an adjustment screw mounted behind each core half which can be used to adjust the axial position of the core halves relative to one another and thereby adjust the gap therebetween.

The arrangement of shell core halves 6 and 12 is such that when key bit 1 is inserted in locking cylinder 11, the two shell core halves 6 and 12 exactly oppose each other on the periphery of locking cylinder 11, forming only a narrow air gap between each other. This permits, on the one hand, an inductive transmission by the coils and halves of the miniature shell core, and on the other hand a direct transmission of the light beam between the opto-electronic elements in the key and on the periphery of the locking cylinder.

Preferably, the inductive transmission is used for transmitting the output currents, whereas the photo-electronic transmission is used for the signal currents.

Figure 3:
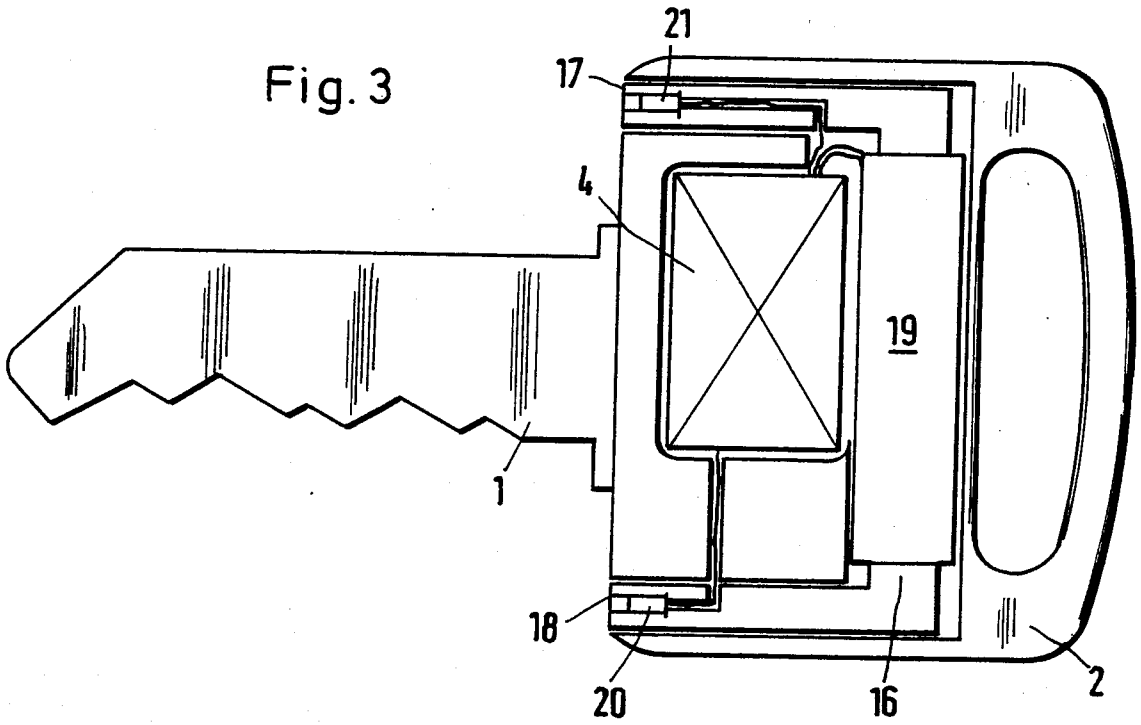
FIG. 3 is a diagrammatic lateral view of the key with a part thereof broken away showing another embodiment of the device according to the present invention.
Figure 4:
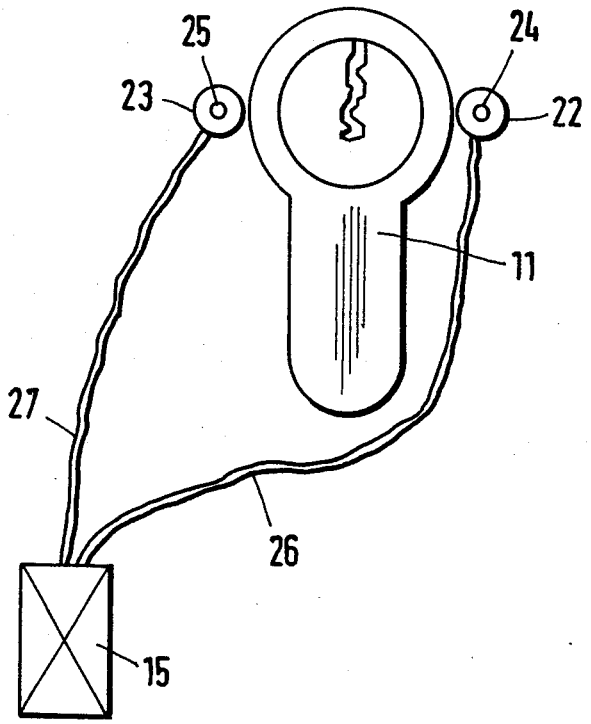
FIG. 4 is a diagrammatic front elevational view of a locking cylinder with a device according to the present invention which matches the key of FIG. 3.

In FIGS. 3 and 4 there is shown another embodiment of the device according to the present invention wherein the key and locking cylinder are basically the same as the embodiment of FIGS. 1 and 2. However, in the present embodiment, the shell core in the key is replaced by a U-shaped ferrite rod 16 which extends across the total width of handle 2 and has two poles 17 and 18. A wide coil 19 is disposed in the center of ferrite rod 16. The photoelectronic elements 20 and 21 are provided within poles 17 and 18. Both coil 19 and photoelectronic elements 20 and 21 are connected to microcomputer 4 by suitable leads.

In FIG. 4 it is seen that ferrite bodies 22 and 23 are provided on locking cylinder 11, one on one side and one on the other side of the cylinder. Photoelectronic elements 24 and 25 are provided within the bores of ferrite bodies 22 and 23. Both the coils of ferrite bodies 22 and 23 and the photoelectronic elements 24 and 25 are connected to the communicating electronics 15 of locking cylinder 11 by means of leads 26 and 27.

Utilization of the U-shaped ferrite rod permits a significantly larger winding and thus higher output within the medium range and consequently superior output transmission for the power supply.

Another advantage of the device according to the present invention is that it permits a so-called "pulse sequence circuit", by means of which defined doors can be controlled at defined times from a central station in such a way that these doors only can be unlocked or locked. This can be achieved, for example by changing the polarity of the two poles 17 and 18 of the U-shaped ferrite rod 16.

A number of advantages are gained by the device according to the present invention. Both the key and the communicating electronics of the locking cylinder can be equipped with a microcontroller and an erasable PROM. The communication between the two takes place by way of a bidirectional, sequentially organized, inductive optical interface. Since the key and the locking cylinder each have their own intelligence, a highly sophisticated dialogue is possible, assuring extremely high security against sabotage. The electronics on the locking cylinder operates selectively in the "stand-alone" mode (individual doors etc.) or in combination with a controlling central station.

For securing individual locks, the electronics on the locking cylinder operates in the "stand-alone" mode. The key and the locking cylinder are suitably programmed with respect to each other with the help of a programming device. Such programming can be altered at a later time without dismantling the electronics.

If the system is operated from a central station, all locking cylinders are connected to the central location by means of a sequentially organized, sabotage-proof interface. Each locking cylinder is programmed directly from the central location. The key may be programmed by means of a special programming slot in the central location.

In operation, the dialogue between the key and locking cylinder commences after the key has been inserted in the lock, when a security prologue takes place before the actual data are exchanged, i.e., a preprogrammed sequence of codes is exchanged by dialogue between the key and locking cylinder.

When core halves 6 and 12 are aligned, electrical energy is supplied to microcomputer 4 by communicating electronics 15. Once microcomputer 4 is energized, it activates optical electronic element 8 (led) to pass a code to passive optical electronic element 13 which in turn transmits the code to communicating electronics 15. If the code received by communicating electronics 15 is recognized, it then activates locking cylinder 11 to permit operation thereof by key bit 1.

The microcomputer 4 is energized by line 9 across inductivity 12, 6. The optical electronic element 8 transmits information to the optical electronic element 13 and across the line 14 to the electronic element 15. The electronic element 15 is connected either with electromechanical lock on the door or with the central station for the further data processing, blocking or releasing.

On the same principle operates the coil 19 which is connected with the computer 4, and the optical electronic elements 20, 21 are connected with the computer 4.

The elements indicated in the above are identified as follows:

Computer 4 may be the microcomputer and controller produced by Gelhard-Engineering in hybridtechnology;

Elements 8, 13, 20, 21 may be chip infrared light emitting diodes produced by TFK (Telefunken);

Electronic element 15 may be a microcomputer produced by Gelhard-Engineering in hybridtechnology with central control outputs;

Coil 19 may be widget coil produced by R. Jahre.

The embodiment of FIGS. 1 and 2 may be modified in such a way that the part of the multiple coupler integrated in the key consists of a miniature shell core half 6 which is provided with a coil having one part of a capacitive element arranged in its center bore; and the part of the multiple coupler disposed on the cylinder side consists of the other miniature shell core half 12 also provided with a coil and having the other part of said capacitive element arranged in its center bore, in a way such that when the key is inserted, only a narrow air gap is formed between the halves 6 and 12 of the shell core at least at one point.

The device shown in FIGS. 3 and 4 has the further advantage that the direction of rotation or turning of the key can be recognized by changing the polarity, for example with the use of a permanent magnet or electrically excited ferromagnets replacing ferrite bodies 22, 23.

In special cases, it may be possible to dispense with the opto-electronic element or the capacitive element and to transmit the output current and coding only via the inductive arrangement. In this case, it would be necessary to superimpose the control current over the inductively transmitted output current.

While a few embodiments of the present invention have been shown and described, it will be obvious that many changes and modifications may be made thereunto without departing from the spirit and scope of the invention.

What is claimed is:

1. A device for the contactless coupling of the control and output currents between the electronic elements on the locking cylinder and the electronic elements in the key, which is provided with a handle, of an electro/mechanical locking device, comprising a multiple coupler consisting of a first part integrated in the key handle and a second part disposed on the periphery of the locking cylinder, said first and second parts being disposed so that when the key is inserted in the locking cylinder said first and second parts oppose each other so that a contactless electrical coupling of the control and output currents occurs between the electronic elements on the locking cylinder and the electronic elements in the key, wherein the first part of said multiple coupler is comprised of a ferrite rod having a center bore and a coil, said ferrite rod having a passive or active opto-electronic element disposed in its center bore, and the second part of the multiple coupler on the locking cylinder is comprised of a ferrite body having a center bore and a coil and an active or passive opto-electronic element disposed in its center bore, so that when the key is inserted, only a narrow air gap is formed at at least one point between the ferrite elements.

2. A device for the contactless coupling of the control and output currents between the electronic elements on the locking cylinder and the electronic elements in the key, which is provided with a handle, of an electro/mechanical locking device, comprising a multiple coupler consisting of a first part integrated in the key handle and a second part disposed on the periphery of the locking cylinder, said first and second parts being disposed so that when the key is inserted in the locking cylinder said first and second parts oppose each other so that a contactless electrical coupling of the control and output currents occurs between the electronic elements on the locking cylinder and the electronic elements in the key, wherein the first part of said multiple coupler is comprised of a ferrite rod having a center bore and a coil and having one part of a capacitive element disposed in its center bore, and the second part of the multiple coupler on the locking cylinder is comprised of a ferrite body having a center bore and a coil and having the other part of the capacitive element disposed in its center bore, so that when the key is inserted, only a narrow air gap is formed at at least one point between the ferrite elements.

3. The device as defined in claim 1, wherein at least one of said halves of the shell core is axially adjustable.

4. The device as defined in claim 1, wherein the key includes a handle and the part of the multiple coupler integrated in the key comprises a U-shaped ferrite rod arranged in the key handle which forms two poles, said rod including a coil and opto-electronic elements inserted in bores of the poles, and ferrite bodies having inserted opto-electronic elements arranged on the periphery of the locking cylinder.

5. The device as defined in claim 1, wherein the coil and the photo-electronic elements of the key are connected to a micro-computer or micro-controller disposed in the key handle, and the photo-electronic element in the periphery of the locking cylinder is connected to the communicating electronics of the locking cylinder in order to permit a bidirectional contactless contact between the computer and the communicating electronics and transmission of the output current.

6. The device as defined in claim 1 wherein the multiple coupler consists of an inductive ferrite core arrangement.

* * * * *